US011781791B2

(12) United States Patent
Mahmoud et al.

(10) Patent No.: US 11,781,791 B2
(45) Date of Patent: Oct. 10, 2023

(54) EJECTOR HEAT PUMP OPERATION

(71) Applicant: Carrier Corporation, Palm Beach Gardens, FL (US)

(72) Inventors: Ahmad M. Mahmoud, Bolton, CT (US); Jinliang Wang, Ellington, CT (US); Frederick J. Cogswell, Glastonbury, CT (US); Parmesh Verma, South Windsor, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 17/253,855

(22) PCT Filed: May 23, 2019

(86) PCT No.: PCT/US2019/033735

§ 371 (c)(1),
(2) Date: Dec. 18, 2020

(87) PCT Pub. No.: WO2020/055462

PCT Pub. Date: Mar. 19, 2020

(65) Prior Publication Data

US 2021/0270509 A1 Sep. 2, 2021

Related U.S. Application Data

(60) Provisional application No. 62/729,226, filed on Sep. 10, 2018.

(51) Int. Cl.

| | |
|---|---|
| ***F25B 49/02*** | (2006.01) |
| ***F25B 13/00*** | (2006.01) |
| *F25B 41/42* | (2021.01) |

(52) U.S. Cl.

CPC ..... *F25B 13/00* (2013.01); *F25B 49/02* (2013.01); *F25B 41/42* (2021.01);
(Continued)

(58) Field of Classification Search

CPC ..... F25B 13/00; F25B 41/42; F25B 49/02; F25B 2313/00; F25B 2313/0293;
(Continued)

(56) References Cited

U.S. PATENT DOCUMENTS

| | | | |
|---|---|---|---|
| 7,779,647 | B2 | 8/2010 | Takeuchi et al. |
| 9,612,047 | B2 | 4/2017 | Higashiue et al. |

(Continued)

FOREIGN PATENT DOCUMENTS

| | | | |
|---|---|---|---|
| CN | 102042721 A | 5/2011 | |
| EP | 1809501 A2 * | 7/2007 | ..... B60H 1/00764 |

(Continued)

OTHER PUBLICATIONS

International Search Report and Written Opinion dated Aug. 27, 2019 for PCT/2019/033735.

(Continued)

*Primary Examiner* — Jonathan Bradford
(74) *Attorney, Agent, or Firm* — Bachman & LaPointe, P.C.

(57) ABSTRACT

A method for operating a heat pump (20; 300) includes operating in a cooling mode wherein heat is absorbed by refrigerant in the indoor heat exchanger (26) and rejected by refrigerant in the outdoor heat exchanger (24). The heat pump switches to operation in a heating mode wherein heat is rejected by refrigerant in the indoor heat exchanger, heat is absorbed by refrigerant in the outdoor heat exchanger, and there is an ejector (60) motive flow and ejector secondary flow. In the heating mode a refrigerant pressure (PH) or temperature (TL) is measured and, responsive to the measured refrigerant pressure or temperature, at least one of a fan speed is changed and a needle (132) of the ejector is actuated.

26 Claims, 7 Drawing Sheets

(52) U.S. Cl.
CPC ..... *F25B 2313/0293* (2013.01); *F25B 2341/0013* (2013.01); *F25B 2400/23* (2013.01); *F25B 2600/11* (2013.01); *F25B 2700/1931* (2013.01); *F25B 2700/1933* (2013.01); *F25B 2700/21162* (2013.01); *F25B 2700/21163* (2013.01); *F25B 2700/21174* (2013.01); *F25B 2700/21175* (2013.01)

(58) Field of Classification Search
CPC ..... F25B 2341/0013; F25B 2600/11; F25B 2700/1931; F25B 2700/1933; F25B 2700/21162; F25B 2700/21163; F25B 2700/21174; F25B 2700/21175
See application file for complete search history.

(56) References Cited

U.S. PATENT DOCUMENTS

| | | | | |
|---|---|---|---|---|
| 9,683,762 | B2 | 6/2017 | Kawano et al. | |
| 2004/0255613 | A1* | 12/2004 | Choi | F25B 41/00 62/500 |
| 2011/0083454 | A1* | 4/2011 | Kopko | F25B 49/027 62/181 |
| 2012/0180510 | A1* | 7/2012 | Okazaki | F25B 13/00 62/218 |
| 2013/0180690 | A1* | 7/2013 | Yura | F25B 13/00 165/121 |
| 2016/0290683 | A1 | 10/2016 | Mahmoud et al. | |
| 2017/0211853 | A1* | 7/2017 | Feng | F25B 41/20 |
| 2018/0058738 | A1 | 3/2018 | Yokoyama et al. | |
| 2018/0187929 | A1 | 7/2018 | Liu et al. | |

FOREIGN PATENT DOCUMENTS

| | | | | |
|---|---|---|---|---|
| JP | 2002/349977 | A | | 12/2002 |
| JP | 2007/139361 | A | | 6/2007 |
| JP | 2007/292390 | A | | 11/2007 |
| JP | 2008/116124 | A | | 5/2008 |
| JP | 2009270785 | A | | 11/2009 |
| JP | 2010/019133 | A | | 1/2010 |
| JP | 4626380 | B2 | | 2/2011 |
| JP | 4781390 | B2 | | 9/2011 |
| KR | 20140052653 | A | * | 5/2014 |
| WO | 2012/160426 | A1 | | 11/2012 |
| WO | 2014/076905 | A1 | | 5/2014 |
| WO | 2017/087794 | A1 | | 5/2017 |
| WO | 2018/046026 | A1 | | 3/2018 |

OTHER PUBLICATIONS

European Search Report dated Oct. 8, 2021 for European Patent Application No. 21187722.0.

* cited by examiner

EJECTOR HEAT PUMP OPERATION

CROSS-REFERENCE TO RELATED APPLICATION

Benefit is claimed of U.S. Patent Application No. 62/729,226, filed Sep. 10, 2018, and entitled "Ejector Heat Pump Operation", the disclosure of which is incorporated by reference herein in its entirety as if set forth at length.

U.S. GOVERNMENT RIGHTS

The invention was made with U.S. Government support under contract W912HQ-17-C-0029 awarded by the U.S. Army. The U.S. Government has certain rights in the invention.

BACKGROUND

The disclosure relates to heat pumps. More particularly, the disclosure relates to the operation of heat pumps with an ejector.

Global environment and energy concerns have lead the HVAC&R (heating, ventilation, air conditioning, and refrigeration) industry to intensify research related to the development of high efficiency HVAC&R systems. Using an ejector as an alternative expansion device in traditional HVAC&R to recover expansion losses occurring in the expansion valves in conventional cycles has been a promising approach to improve conventional HVAC&R system performance.

A typical ejector refrigeration cycle comprises a condenser, a compressor, an evaporator, a separator, an ejector (or an additional expansion valve or possible suction line heat exchanger). A primary or motive flow of high pressure refrigerant from the condenser enters the primary or motive port (inlet) and passes through the motive nozzle of the ejector where it accelerates. It exits the motive nozzle with a high velocity and generates low pressure area around the exit. A secondary or suction flow of refrigerant vapor from the evaporator is entrained (i.e., sucked) into the secondary or suction port (inlet) of the ejector and is thereby accelerated. High velocity motive flow refrigerant decelerates and mixes with accelerating suction flow refrigerant in the mixing section (mixer) of the ejector. After mixing, the two phase refrigerant mixture enters the diffuser of the ejector, decelerates thereby recovering pressure. The resulting two-phase refrigerant stream enters the separator where the vapor and liquid phases are separated. Vapor is sucked into the compressor where it is compressed and discharged to the condenser or gas cooler. In the condenser, the compressed high pressure, high temperature vapor is cooled and condensed. High pressure liquid from the condenser feeds the motive port of the ejector. Liquid from the separator enters the evaporator after passing through an expansion valve, evaporates and vapor flows to the suction port of the ejector.

The main performance parameters of an ejector are entrainment ratio, pressure lift ratio, efficiency, and capacity. Entrainment ratio is the mass flow rate ratio of secondary flow to primary flow. Pressure lift ratio is the ratio of fluid pressure at the ejector outlet and that of the vapor pressure at the secondary inlet. Via use of an ejector, the coefficient of performance (COP) of a refrigeration cycle can be improved up to 50% for transcritical (e.g. $CO_2$) cycles and up to 21% for subcritical refrigerants (e.g., HFC, HC, HFO, and the like).

However, cycle performance improvements may diminish when the ejector operation condition deviate from the design or optimum operating point (e.g. off-design). Examples include air-source heat pumps and transportation refrigeration where there is such a wide range of operation. For some applications such as mild winter conditions with outdoor temperatures in the range of 30° F. to 65° F. (−1° C. to 18° C.) the ejector may not operate as it is intended to because of low or very low potential of work recovery from the high-pressure motive flow. Under these cases a parallel expansion valve usually is utilized to bypass the ejector (WO2017/087794A1, May 26, 2017, of Mahmoud et al.). This approach increases not only the system complexity but also the system cost.

An advanced ejector-based proposal is seen in United States Patent Application Publication 20180187929A1, Liu et al., Jul. 5, 2018, "Ejector Heat Pump". Another is seen in United States Patent Application Publication 20170211853A1, Feng et al., Jul. 27, 2017, "Heat Pump with Ejector". Another is seen in United States Patent Application Publication 20160290683A1, Mahmoud et al., Oct. 6, 2016, "Wide Speed Range High-Efficiency Cold Climate Heat Pump".

SUMMARY

One aspect of the disclosure involves a method for operating a heat pump. The heat pump is operated in a cooling mode wherein heat is absorbed by refrigerant in the indoor heat exchanger and rejected by refrigerant in the outdoor heat exchanger. The heat pump switches to operation in a heating mode wherein heat is rejected by refrigerant in the indoor heat exchanger, heat is absorbed by refrigerant in the outdoor heat exchanger, and there is an ejector motive flow and ejector secondary flow. In the heating mode a refrigerant pressure ($P_H$) or temperature ($T_L$) is measured and, responsive to the measured refrigerant pressure or temperature, at least one of a fan speed is changed and a needle, if any, of the ejector is actuated.

In one or more embodiments of any of the foregoing embodiments, the ejector is uncontrolled (e.g., no needle).

In one or more embodiments of any of the foregoing embodiments, in the cooling mode there is no motive flow to the ejector.

In one or more embodiments of any of the foregoing embodiments, in the heating mode, refrigerant passes from the indoor heat exchanger as the ejector motive flow.

In one or more embodiments of any of the foregoing embodiments, in the cooling mode, flow passes through an expansion device to the indoor heat exchanger. In the heating mode, there is no flow through the expansion device.

In one or more embodiments of any of the foregoing embodiments, in the cooling mode, flow passes through an expansion device to the indoor heat exchanger. In the heating mode, flow passes through the expansion device to the outdoor heat exchanger.

In one or more embodiments of any of the foregoing embodiments, in the heating mode, the measuring of a refrigerant pressure is a measuring of a discharge pressure of the compressor.

In one or more embodiments of any of the foregoing embodiments, in the heating mode, the changing the fan speed occurs and comprises increasing fan speed when the measured pressure exceeds a first threshold pressure ($P_{high}$) and decreasing fan speed when the measured pressure falls below a second threshold pressure ($P_{low}$).

In one or more embodiments of any of the foregoing embodiments, in the heating mode, the actuating the needle of the ejector occurs and comprises retracting the needle when the measured pressure exceeds a first threshold pressure ($P_{high}$) and extending the needle when the measured pressure falls below a second threshold pressure ($P_{low}$).

In one or more embodiments of any of the foregoing embodiments, a heat pump has a controller configured to perform the method.

In one or more embodiments of any of the foregoing embodiments, the controller is configured so that: in the cooling mode, flow passes through an expansion device to the indoor heat exchanger; and in the heating mode, there is no flow through the expansion device.

In one or more embodiments of any of the foregoing embodiments, the controller is configured so that: in the cooling mode, flow passes through an expansion device to the indoor heat exchanger; and in the heating mode, flow passes to the outdoor heat exchanger without the need of an expansion device.

In one or more embodiments of any of the foregoing embodiments, the controller is configured so that: the changing the fan speed comprises increasing fan speed when the measured pressure exceeds a first threshold pressure ($P_{high}$) and decreasing fan speed when the measured pressure falls below a second threshold pressure ($P_{low}$).

In one or more embodiments of any of the foregoing embodiments, the controller is configured so that: the actuating the needle of the ejector comprises retracting the needle when the measured pressure exceeds a first threshold pressure ($P_{high}$) and extending the needle when the measured pressure falls below a second threshold pressure ($P_{low}$).

In one or more embodiments of any of the foregoing embodiments, there is no expansion device in parallel with the ejector.

Another aspect of the disclosure involves a heat pump. The heat pump comprises: a compressor; an indoor heat exchanger; a fan positioned to drive an air flow across the indoor heat exchanger; an outdoor heat exchanger; an ejector; a controller. At least one of: the ejector is a controllable ejector; and the fan is a variable speed fan controlled by the controller. The heat pump further includes means for switching between a cooling mode and a heating mode. In the cooling mode, heat is absorbed by refrigerant in the indoor heat exchanger and rejected by refrigerant in the outdoor heat exchanger. In the heating mode, heat is rejected by refrigerant in the indoor heat exchanger, heat is absorbed by refrigerant in the outdoor heat exchanger, and there is an ejector motive flow and ejector secondary flow. The controller is configured to in the heating mode: measure a refrigerant pressure ($P_H$) or temperature ($T_L$); and responsive to the measured refrigerant pressure or temperature, at least one of change the fan speed and actuate a needle, if any, of the ejector.

In one or more embodiments of any of the foregoing embodiments, the controller is configured so that: in the cooling mode, flow passes through an expansion device to the indoor heat exchanger; and in the heating mode, there is no flow through the expansion device.

In one or more embodiments of any of the foregoing embodiments, the controller is configured so that: in the cooling mode, flow passes through an expansion device to the indoor heat exchanger; and in the heating mode, flow passes to the outdoor heat exchanger without the need of an expansion device.

In one or more embodiments of any of the foregoing embodiments, the controller is configured so that: the changing the fan speed comprises increasing fan speed when the measured pressure exceeds a first threshold pressure ($P_{high}$) and decreasing fan speed when the measured pressure falls below a second threshold pressure ($P_{low}$).

In one or more embodiments of any of the foregoing embodiments, the controller is configured so that: the actuating the needle of the ejector comprises retracting the needle when the measured pressure exceeds a first threshold pressure ($P_{high}$) and extending the needle when the measured pressure falls below a second threshold pressure ($P_{low}$).

In one or more embodiments of any of the foregoing embodiments, at least one of: there is no expansion device in parallel with the ejector; and the ejector is a non-controllable ejector.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
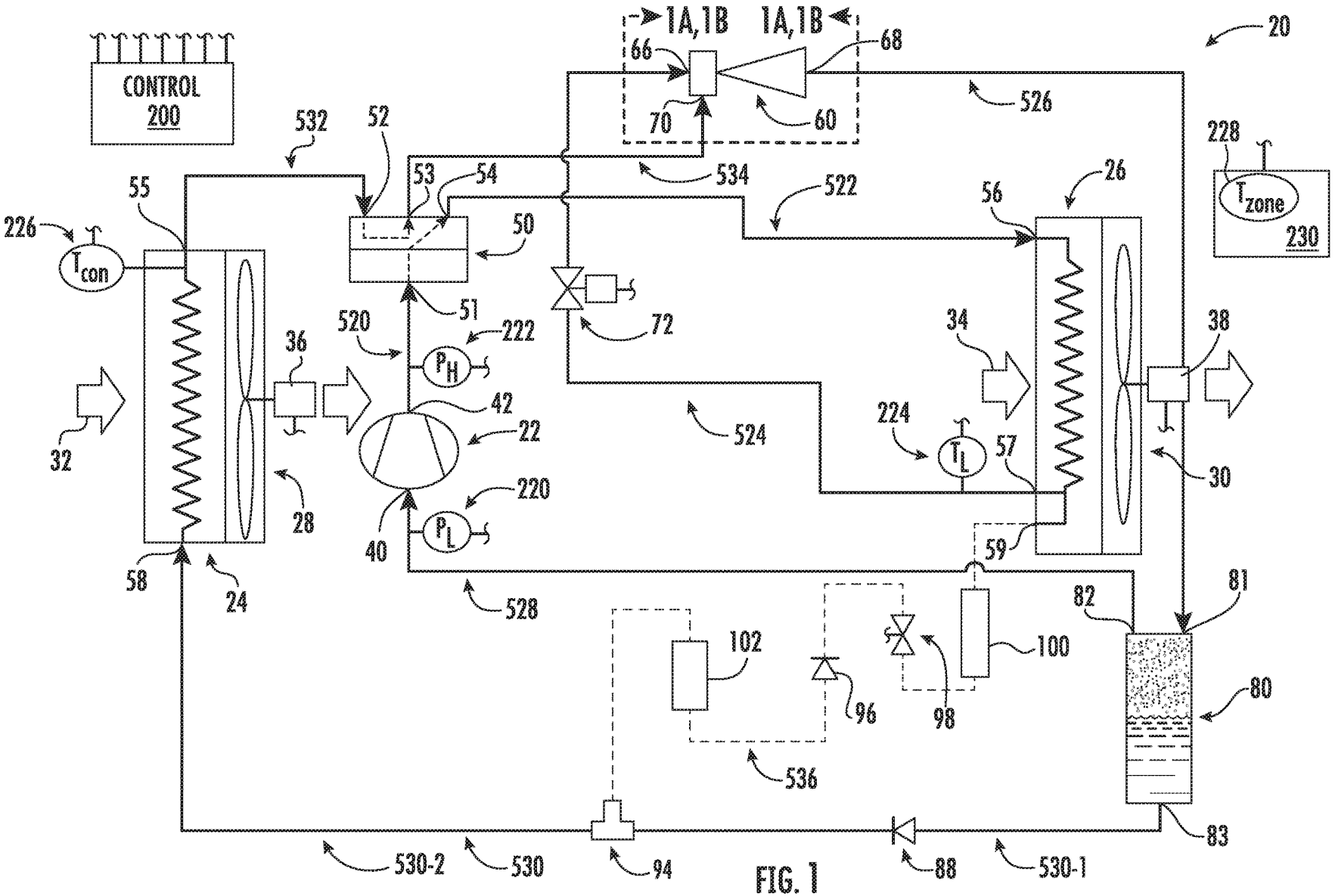
FIG. 1 is a schematic view of a first heat pump system in a heating mode.

FIG. 1 shows a vapor compressor system 20 which, in one group of examples, is a commercial type heat pump unit. The system 20, along a vapor compression flowpath, has: a compressor 22; an outdoor heat exchanger 24; and an indoor heat exchanger 26. The exemplary heat exchangers 24 and 26 are refrigerant-air heat exchangers each having a respective associated fan 28, 30 for driving a respective airflow 32, 34 across the heat exchanger to exchange heat with refrigerant passing along a leg of the refrigerant flowpath through the heat exchanger. Exemplary refrigerant is an HFC such as R410A, R134a, and the like.

Exemplary fans are electrically-powered fans having respective electric motors 36, 38.

The compressor 22 has a suction or inlet port 40 and a discharge or outlet port 42. The compressor also includes an electric motor (not shown) for driving working elements of the compressor to compress low pressure refrigerant received through the suction port and discharge high pressure refrigerant from the discharge port. FIG. 1 also shows a control system or controller 200 coupled to control operation of the fan motors and compressor motor and other controllable system components to allow operation in a heating mode and a cooling mode.

In the heating mode, heat is rejected by refrigerant in the indoor heat exchanger 26 and absorbed by refrigerant in the outdoor heat exchanger 24. In the cooling mode, heat is rejected by refrigerant in the outdoor heat exchanger 24 and absorbed by refrigerant in the indoor heat exchanger 26.

The controllable components for mode switching include one or more valves. The one or more valves include an exemplary four-way valve 50 used to switch between the modes.

In an exemplary configuration as a residential heat pump, the outdoor heat exchanger and compressor are in an outdoor unit and the indoor heat exchanger is in an indoor unit. In another exemplary configuration as a commercial heat pump, both the outdoor and indoor heat exchangers and compressor are in one outdoor unit. Components of the control system may be distributed throughout as is known in the art (e.g., a thermostat 230 indoors while main control portions are outdoors in the outdoor unit). As so far described, the system is representative of several of many baseline systems to which the further teachings below may be applied.

Figure 1A:
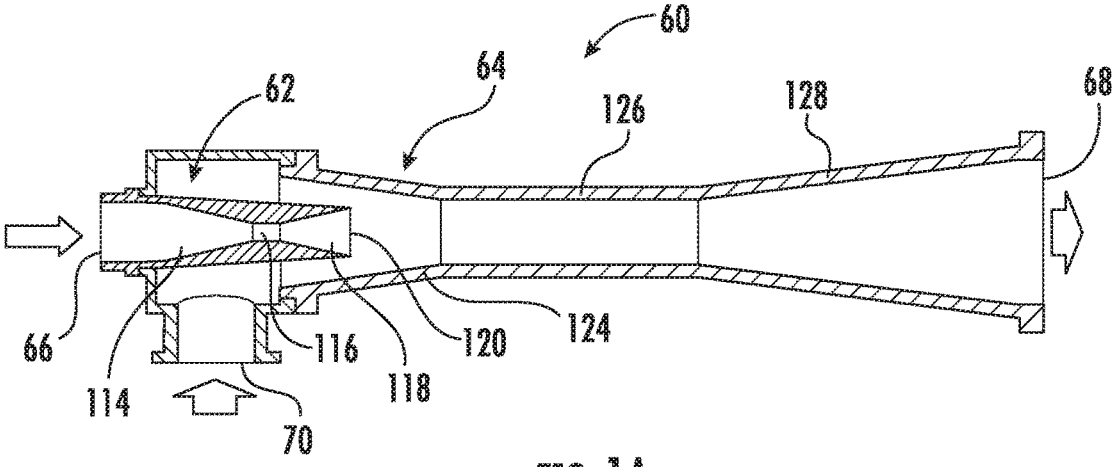
FIG. 1A PRIOR ART
FIG. 1A is a view of a fixed ejector in the first heat pump system.

The FIG. 1 system includes an ejector 60. The exemplary ejector 60 (FIG. 1A) is formed as the combination of a motive (primary) nozzle 62 nested within an outer member 64. The motive (primary) flow inlet 66 is the inlet to the motive nozzle. The outlet 68 is the outlet of the outer member 64. The motive refrigerant flow enters the inlet 66 and then passes into a convergent section 114 of the motive nozzle. It then passes through a throat section 116 and an expansion (divergent) section 118 through an outlet (exit) 120 of the motive nozzle. The motive nozzle accelerates the flow and decreases the pressure of the flow.

The secondary flow inlet 70 forms an inlet of the outer member 64. The pressure reduction caused to the motive flow by the motive nozzle helps draw the secondary flow into the outer member. The outer member includes a mixer having a convergent section 124 and an elongate throat or mixing section 126. The outer member also has a divergent section or diffuser 128 downstream of the elongate throat or mixing section 126. The motive nozzle outlet 120 is positioned within the convergent section 124. As the motive flow exits the outlet 120, it begins to mix with the secondary flow with further mixing occurring through the mixing section 126 which provides a mixing zone. Thus, respective motive and secondary flowpaths extend from the motive flow inlet and secondary flow inlet to the outlet, merging at the exit.

The exemplary ejector 60 is a fixed or uncontrolled ejector lacking a needle or similar means for throttling the motive nozzle. Alternative embodiments comprising a controlled ejector are discussed below. The ejector secondary inlet 70 is coupled to receive refrigerant from the outdoor heat exchanger in the FIG. 1 heating mode. In the example shown, the four-way valve 50 has an inlet 51 positioned to receive compressed refrigerant from a flowpath leg or segment 520 from the compressor discharge port 42. Of the three remaining ports, a port 52 is coupled to the outdoor heat exchanger via flowpath leg 532, a port 53 is coupled to the ejector secondary port 70 via flowpath leg 534, and a port 54 is coupled to the indoor heat exchanger via flowpath leg 522. In the FIG. 1 heating mode, the valve element of the four-way valve provides communication between the ports 52 and 53 on the one hand and 51 and 54 on the other hand. Thus, compressed refrigerant is passed to a port 56 of the indoor heat exchanger and refrigerant from a port 55 on the outdoor heat exchanger is passed to the ejector secondary inlet 70.

The refrigerant compressed by the compressor and received by the indoor heat exchanger is condensed in the indoor heat exchanger. The condensed refrigerant passes from a port 57 on the indoor heat exchanger along a flowpath leg 524 to the motive inlet 66. The flowpath leg 524 is a controlled flowpath leg controlled by the controller 200 using a valve 72 (e.g., a solenoid valve). The exemplary bistatic solenoid valve provides simple on-off control. The combined flow discharged from the ejector outlet 68 passes along a flowpath leg 526 to a vessel 80 which, in this mode, functions as a separator. The vessel 80 has an inlet port 81 receiving the combined flow, a first outlet 82 returning vapor via a flowpath leg 528 to the compressor suction port 40 and a second outlet port 83 passing refrigerant via a flowpath leg 530 (having sublegs or segments 530-1 or 530-2) to a port 58 on the evaporator through a flowpath segment. The flowpath leg 530 includes a check valve 88 to ensure that flow can only exit the port 83. An additional flowpath leg 536 is inoperative in this mode. The additional flowpath leg or branch 536 extends from a tee 94 along the leg 530 (at the junction of legs 530-1 and 530-2) to a port 59 (inlet port) on the indoor heat exchanger. This port is specially configured for two phase flow and may comprise a bundle of capillary tubes.

Notably, the leg 536 includes a check valve 96 ensuring only flow to the indoor heat exchanger. Thus, in an operating condition wherein there is higher pressure at the port 59 than at the tee 94, there will be no flow along this leg 536. The leg 536 further includes an expansion device 98 (e.g., an electronic expansion valve) downstream of the check valve 96 and a distributor 100 downstream of the expansion device. Downstream of the expansion valve 98, two phase refrigerant is distributed through the distributor 100 to many small tubes (not shown) and fed to each coil circuit of the indoor heat exchanger; whereas port 57 is a manifold outlet for single phase refrigerant. A filter 102 may also be located in the leg 536 (e.g., upstream of the check valve to most efficiently filter liquid refrigerant). Operation of this leg 536 in the cooling mode is discussed further below.

Figure 3:
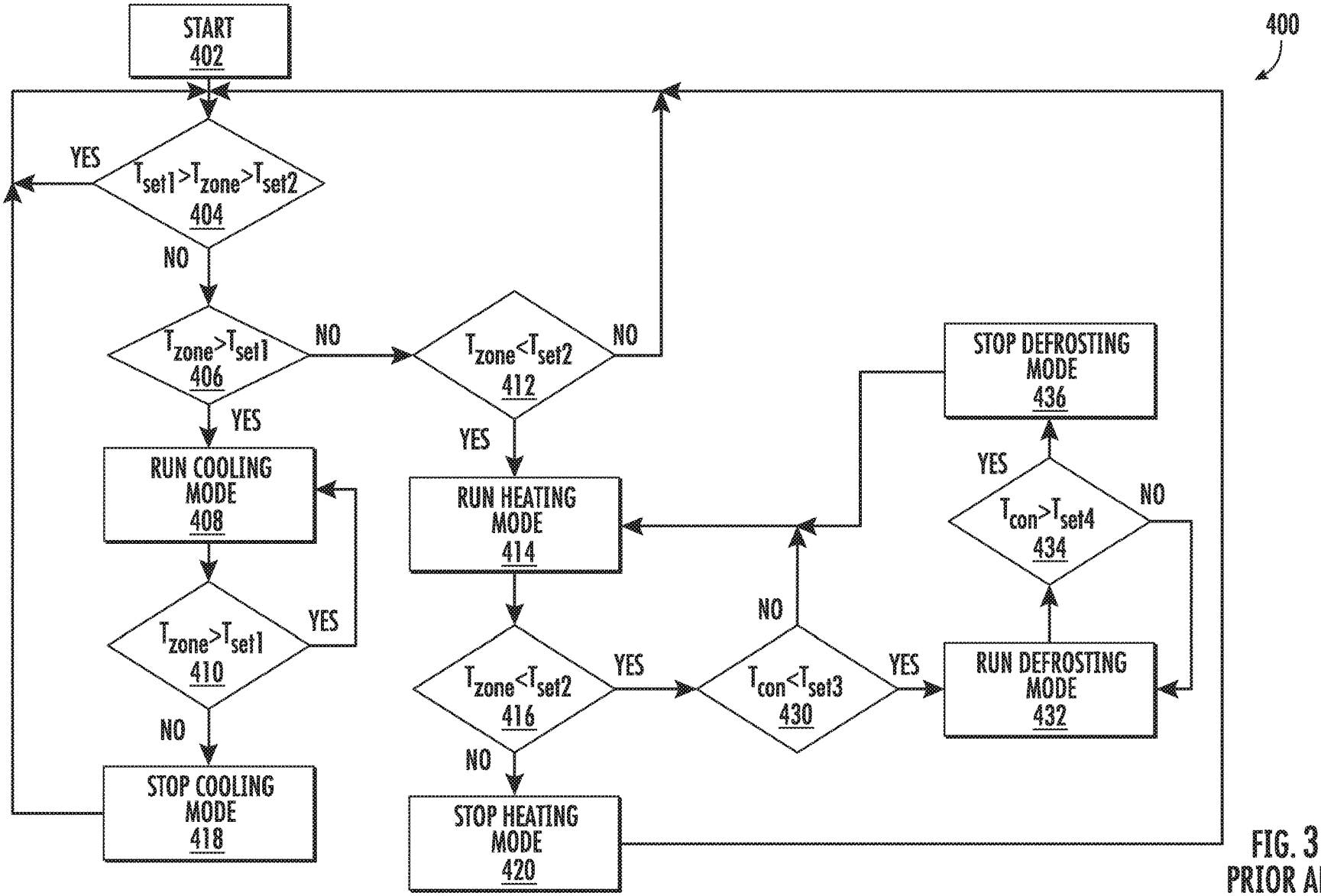
FIG. 3 PRIOR ART
FIG. 3 is a control flowchart for switching between the heating mode, the cooling mode, and a defrost mode.
Figure 4:
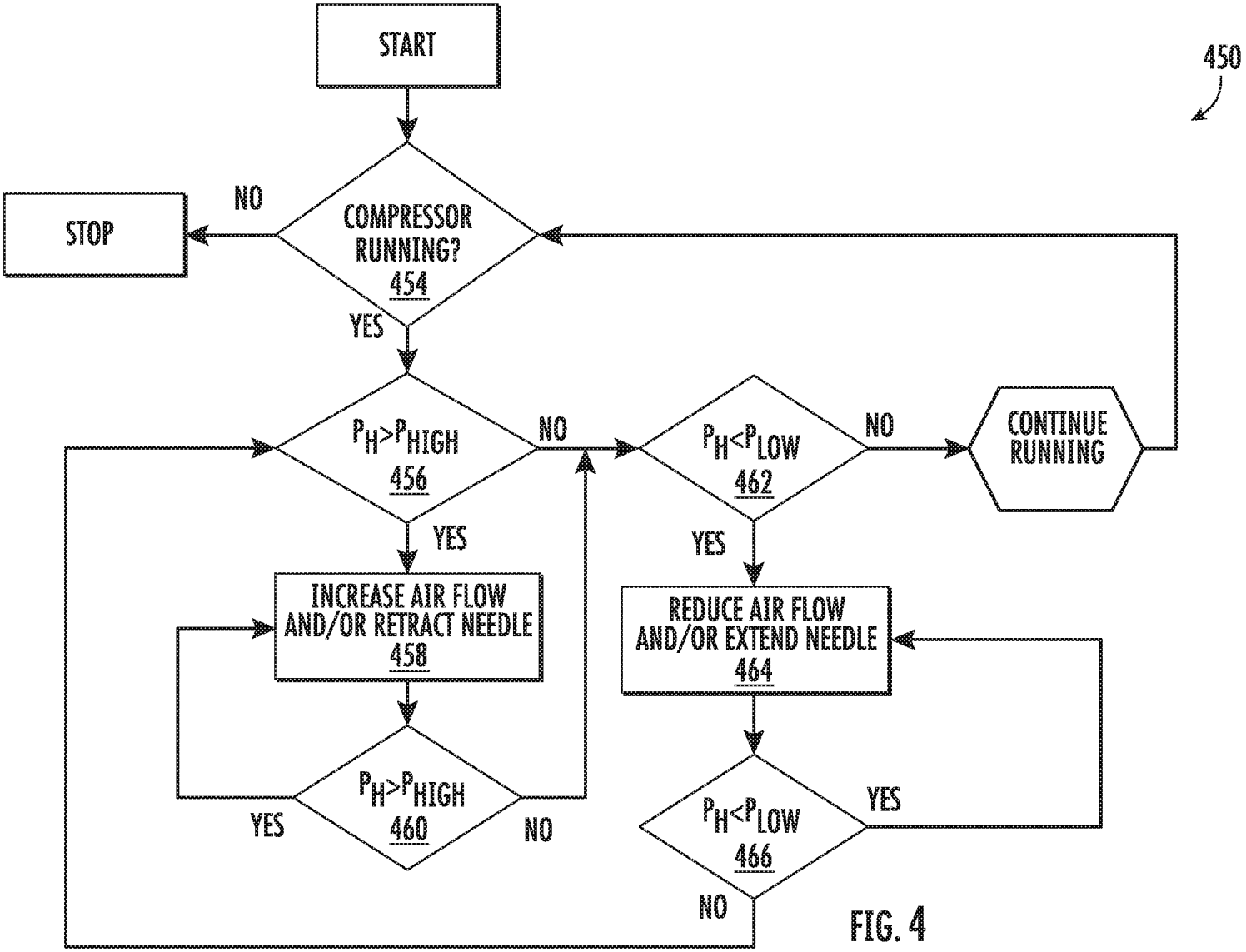
FIG. 4 is a control flowchart for operation within the heating mode.

Operation may be responsive to multiple sensors coupled to the controller 200. The controller may receive user inputs from input devices (e.g., switches, keyboard, or the like such as end user-controllable thermostat switches and manufacturer/installer controllable switches- (not shown)) and sensors (both shown and not shown, e.g., pressure sensors and temperature sensors at various system locations). The controller may be coupled to the sensors and controllable system components (e.g., valves, the fan motors, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components. The controller hardware may represent existing baseline hardware. The controller programming may represent a baseline modified to provide the operation discussed below. FIGS. 3 and 4 show portions of a control routine which may be programmed or otherwise configured into the controller.

FIG. 1 shows a low side pressure sensor 220 and a high side pressure sensor 222 (e.g., both piezoelectric-type). A refrigerant temperature sensor 224 (e.g., thermistor-type) measures the temperature of refrigerant discharged from the indoor heat exchanger to the ejector motive inlet. Additional exemplary temperature sensors (e.g., thermistor-type) include an outdoor coil temperature sensor 226 that measures surface temperature of the condenser coil ($T_{con}$) and an indoor temperature sensor 228 to measure indoor temperature ($T_{zone}$) in the zone being climate controlled (e.g., integrated with a thermostat/user interface unit 230). Additional temperature and pressure sensors may be located throughout as is known in the art for controlling basic system function. Most notably, an indoor air inlet temperature sensor.

Figure 2:
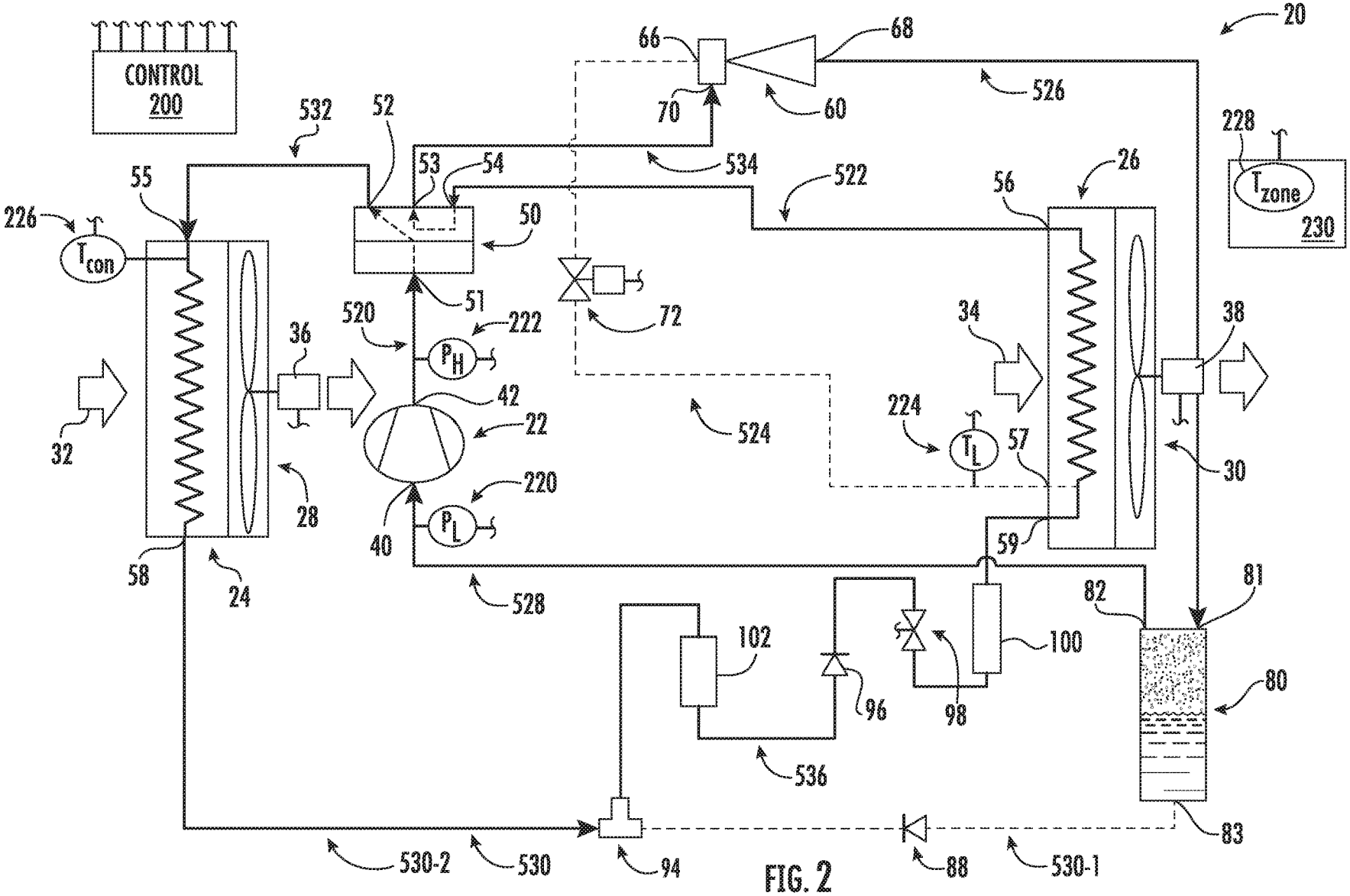
FIG. 2 is a schematic view of the first heat pump system in a cooling mode.

FIG. 2 shows the cooling mode of the system 20 wherein the four-way valve 50 has been switched to place ports 51 and 52 in communication and thereby direct high pressure compressor discharge to the port 55 of the outdoor heat exchanger. Thus, flow through the legs 532 and 530-2 is in the opposite direction of the FIG. 1 heating mode. The check valve 88, however, blocks reverse flow along the leg 530-1. Accordingly, flow may proceed along the leg 536 through the filter 102, check valve 96, expansion device 98, and distributor 100 to the port 59. Flow exits the indoor heat exchanger by the port 56 and passes along the leg 522 in the opposite direction to the FIG. 1 heating mode. The four-way valve 50 places the ports 53 and 54 in communication so that the flow proceeds through the leg 534. However, the flow through the leg 534 does not mix with any flow through the leg 524. The controller has shut the valve 72 to block flow along the leg 524. Thus, flow on the leg 534 proceeds through the ejector along the leg 526 as in the first mode.

An additional mode (not illustrated) is a defrost mode wherein, as in the cooling mode, compressed refrigerant is fed directly to the outdoor heat exchanger to defrost. One potential difference relative to the cooling mode is that the outdoor fan may be shut off. For example, the outdoor fan 36 may be shut off to reduce heat extraction by cold outdoor air from the system and thus accelerate the defrosting process (e.g. hot gas delivered to the outdoor heat exchanger).

Switching between the heating, cooling, and defrost modes may reflect a prior art or modified logic. In an exemplary FIG. 3 logic 400, four set temperatures are involved. The logic comprises operating the system to keep indoor air temperature ($T_{zone}$) between a high temperature (the cooling control point $T_{set1}$) and a low temperature (the heating control point $T_{set2}$). These temperatures may be entered by a user such as on a thermostat which may also include a temperature sensor for measuring $T_{zone}$. Alternative temperature for measuring $T_{zone}$ may be along a flowpath for the airflow 34 upstream of the indoor heat exchanger 26. In one example, $T_{set1}$ may be set to 77° F. (25° C.) while $T_{set2}$ may be set to 68° F. (20° C.).

The third set temperature ($T_{set3}$) is used to determine whether to go into defrost mode. Exemplary $T_{set3}$ is set at the factory or by an installation technician. An exemplary $T_{set3}$ is 28 F. The fourth set temperature ($T_{set4}$) is used to determine whether to end defrosting and back to the heating mode. An exemplary $T_{set4}$ is 68° F. (20° C.). Exemplary $T_{set4}$ is also set at the factory or by an installation technician. When the system enters the defrosting mode, the controller continuously compares condenser surface temperature ($T_{con}$) to $T_{set4}$ to determine whether to continue or end the defrosting mode.

The exemplary FIG. 3 decision matrix or logic 400 involves, after a start 402 determining 404 whether $T_{zone}$ is within the target range. If no, the logic recursively determines 406, 410 whether $T_{zone}$ is greater than $T_{set1}$ and if yes running 408 in the cooling mode. If no, then the controller determines 412, 416 whether $T_{zone}$ is less than $T_{set2}$ and if yes running 414 in the heating mode. If $T_{zone}$ is between those two set temperatures, then the logic loops back repeating until the controller determines $T_{zone}$ is out of that target range (then respectively stopping 418, 420 the cooling mode or heating mode and looping back to the determination 404. If $T_{zone}$ is out of the range, the controller runs the system in either heating mode or cooling mode. In the heating mode, the control has steps for determining whether to start defrosting and whether to end defrosting.

Figure 1B:
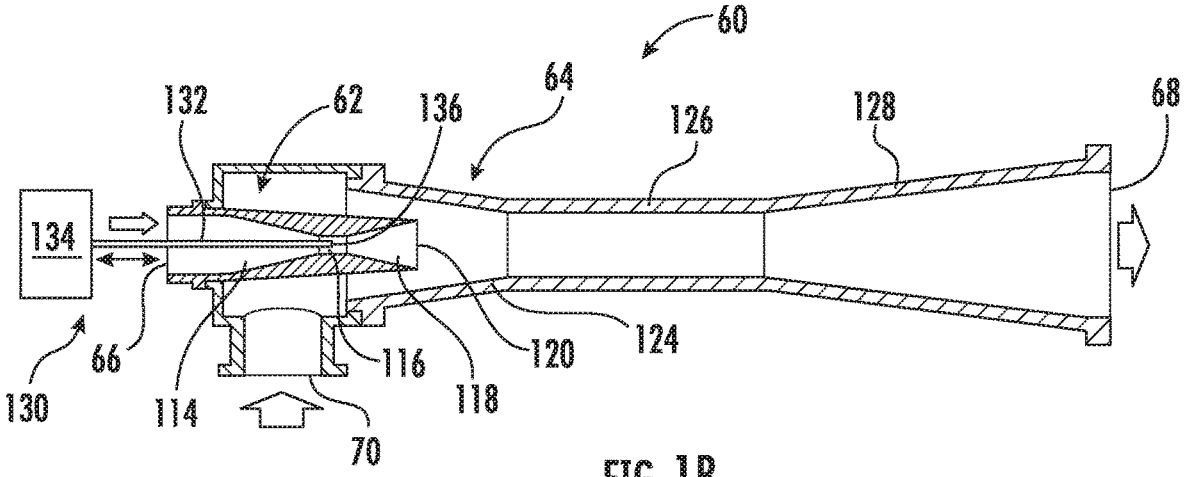
FIG. 1B PRIOR ART
FIG. 1B is a view of an alternative controllable ejector in the first heat pump system.

The controller places 432 the system in the defrost mode when the controller determines 430 that the temperature $T_{con}$ measured by the outdoor coil temperature sensor 226 falls below $T_{set3}$. The controller ends 436 the defrost mode and returns the system returns to heating mode when it determines 434 that the temperature rises above $T_{set4}$. As is discussed below, parameters of operation while in the heating mode may be controlled by the controller controlling fan speed of one or both fans. This is particularly the case for fixed ejectors such as FIG. 1A. If a controllable ejector is used, throttling of the ejector (e.g., via control of its needle) may alternatively or additionally be used with the same basic logic. FIG. 1B shows controllability provided by a needle valve 130 having a needle 132 and an actuator 134. The actuator 134 shifts a tip portion 136 of the needle into and out of the throat section 116 of the motive nozzle 100 to modulate flow through the motive nozzle and, in turn, the ejector overall. Exemplary actuators 134 are electric (e.g., solenoid or the like). The actuator 134 may be coupled to and controlled by the controller 200.

In the exemplary heating mode, the fan and/or ejector control is based upon the input received from the pressure sensors 220 and/or 222. In the illustrated FIG. 4 example, only the sensor 222 is used. This is repeatedly compared to two preset reference pressures $P_{high}$ and $P_{low}$. These two reference pressures represent limits (thresholds) selected based on experimentation or modeling to correspond to a range where the ejector offers improved performance. $P_h$ is constantly compared to $P_{high}$ and, if greater, the airflow is increased and/or the ejector needle retracted to open up the ejector. In one example, only the indoor airflow is increased (and not the outdoor airflow). In another example, both airflows are increased. Increasing only the indoor airflow is particularly relevant in legacy systems that have only a single speed outdoor fan. Whereas, increasing both airflows offers ability to tailor while maintaining desired minimum indoor airflows for purposes such as temperature maintenance or air quality. The increase in airflow may be achieved by the controller positively incrementing fan speed by a given amount.

FIG. 4 shows an exemplary logic 450 of heating mode operation utilizing fan and/or ejector control as discussed above. High side refrigerant pressure $P_h$ is impacted by indoor return air temperature, outdoor air temperature, the indoor air flow, and outdoor air flow (outdoor fan speed and air flow having a lesser effect than indoor). With only fan control, high side pressure is maintained in the optimal range unless the fan speed reaches its minimum or maximum. High side pressure may be similarly controlled by the ejector needle control. High side refrigerant pressure $P_H$ may be measured at the compressor discharge (sensor 222), condenser outlet, or ejector motive inlet or anywhere therebetween. Fan and or ejector control is by checking 454 and ensuring the compressor is on. If the controller determines 456, 460 $P_H$ is higher than the set upper limit ($P_{high}$), the controller increases 458 indoor or outdoor air flow or ejector motive flow by increasing the indoor fan speed or retracting the control needle. The simplest embodiment has a non-controllable ejector and the indoor fan is the sole control method for high-side pressure (e.g., outdoor fan may be a fixed speed fan). If the controller determines 462, 466 $P_H$ is lower than the set low limit ($P_{low}$), the controller reduces 464 air flow or ejector motive flow by decreasing indoor fan speed or inserting the needle.

Once the high-side pressure $P_H$ is within the optimal pressure range (i.e., between $P_{low}$ and $P_{high}$) the fan speed and/or the needle position is maintained without changing.

Figure 5:
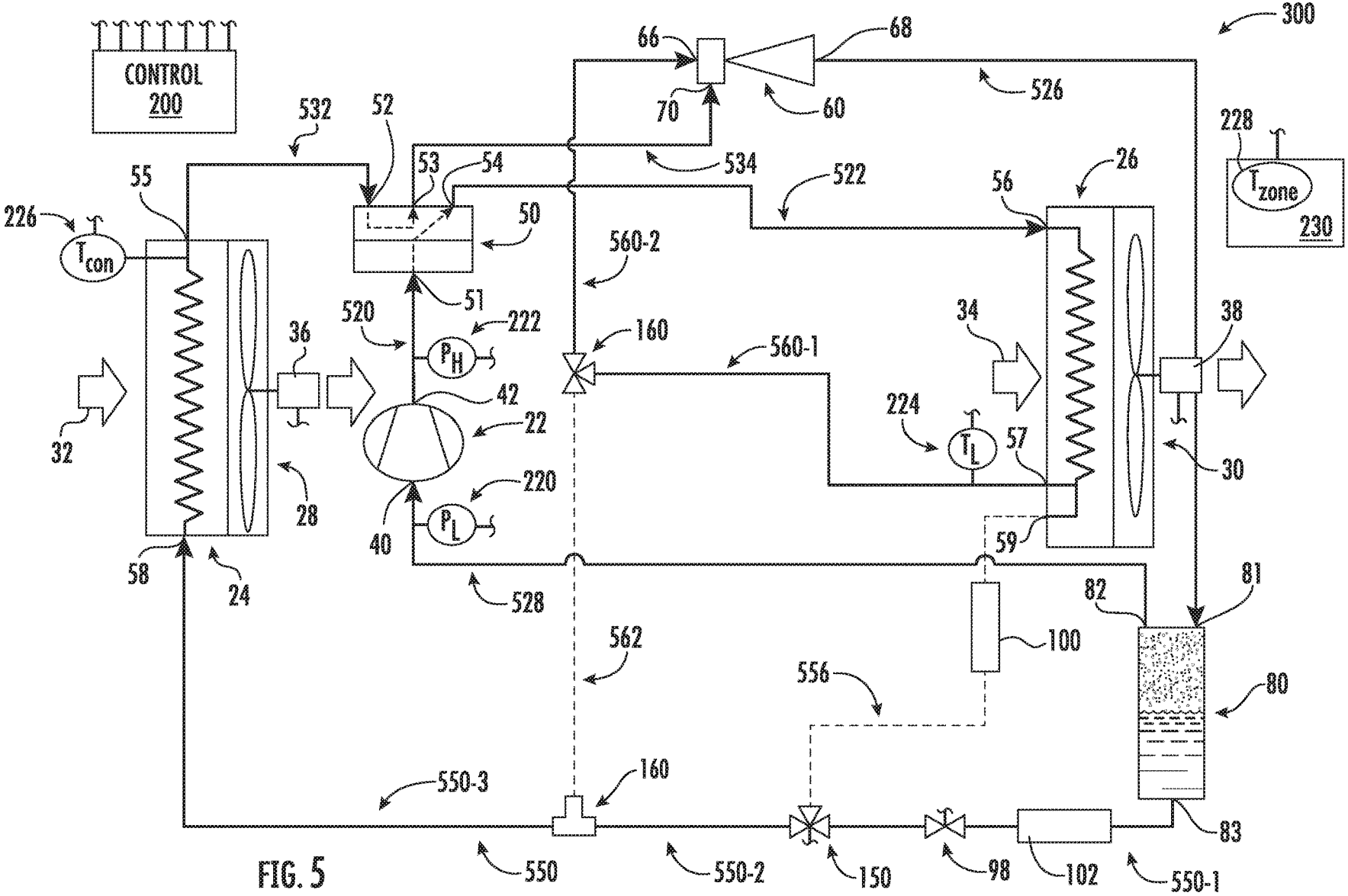
FIG. 5 is a schematic view of a second heat pump system in a heating mode.

FIG. 5 shows an alternate system 300 which differs from the system 20 in enabling ejector 60 to be utilized in the cooling mode with a similar control of fan(s) and/or the ejector to that of the heating mode. The bypass leg 536 of FIG. 1 and flowpath legs 524 and 530 are modified. The leg 530 is replaced by leg 550 in the FIG. 5 mode having segments or legs 550-1, 550-2, 550-3. The filter 102 and EXV 98 are shifted to the leg 550-1 from the FIG. 1 bypass leg 536. The FIG. 1 bypass leg 536 is replaced with a bypass leg 556 still including the distributor 100 and extending from an exemplary three-way valve 150 at the junction of the legs 550-1 and 550-2.

In the FIG. 5 heating mode, the controller 200 maintains the three-way valve providing communication from the leg 550-1 to the leg 550-2 and preventing flow through the leg 556. The bistatic two-way valve 72 of FIG. 1 is also replaced by a second three-way valve 160. Flowpath legs 560-1 and 560-2 respectively meet at the three-way valve 160 and combine to replace the FIG. 1 flowpath leg 524. However, again a further bypass leg 562 is also provided from a tee or junction 160 at the junction of legs 550-2 and 550-3. Again in the FIG. 5 mode, the controller maintains no flow along the leg 562.

Figure 6:
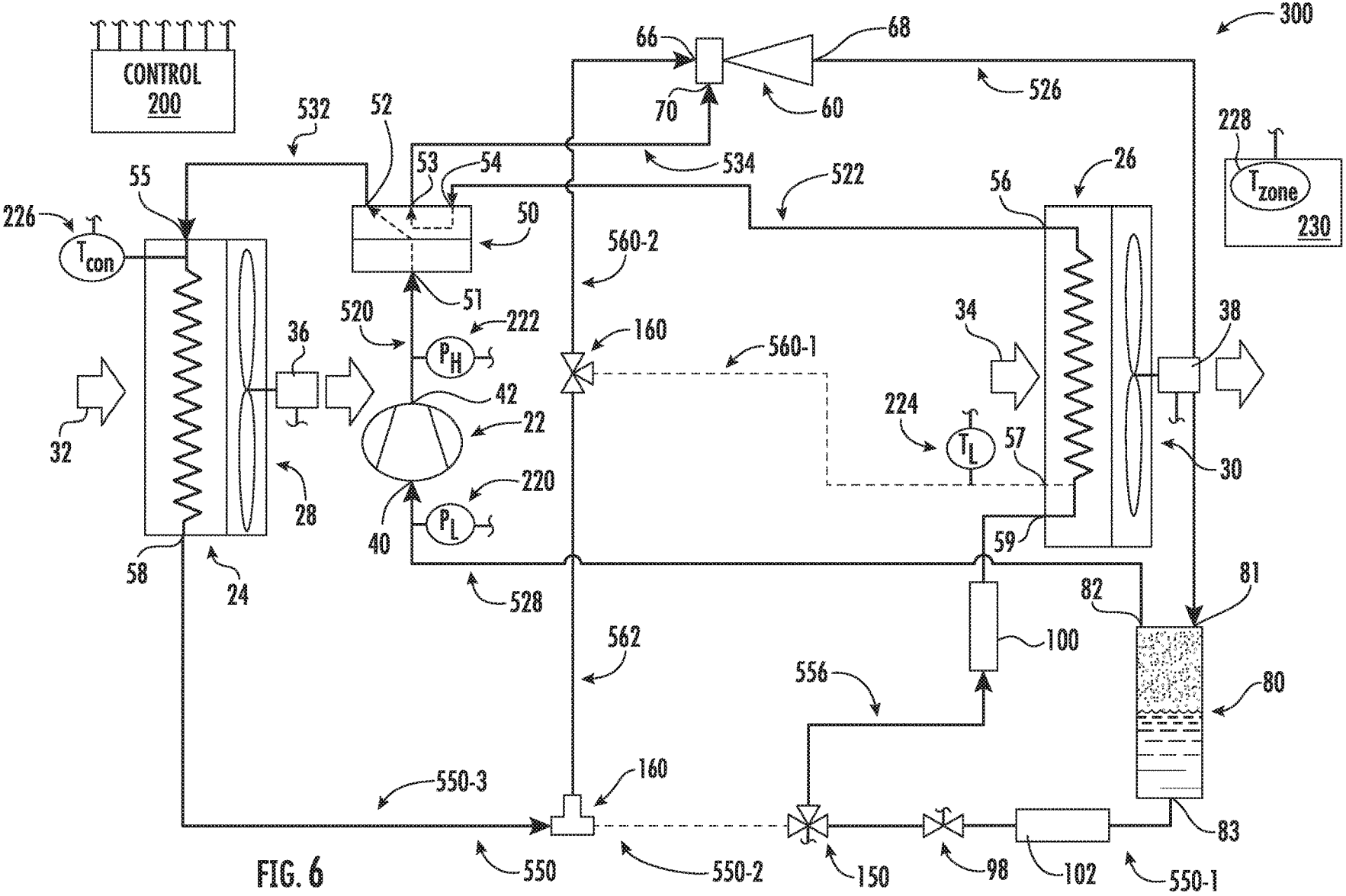
FIG. 6 is a schematic view of the second heat pump system in a cooling mode.

In the FIG. 6 cooling mode, however, the controller has switched the states of the two valves 150 and 160 to block flow along the leg 550-2 and, thus: (a) pass flow from the leg 550-1 through the bypass leg 556; and (b) pass flow from the outdoor heat exchanger port 58 along the leg 550-3 to the leg 562 and therefrom 560-2 to the ejector motive inlet 66. Similarly, the same high side pressure control logic may apply to the cooling mode where the ejector is not bypassed. For example, in the FIG. 6 system there may be different threshold pressures than are used in heating.

Further variations may include multiple staged compressors.

Thus, in the heating mode, the method proposed (e.g. adjusting condenser flow rate, ejector needle control) may provide low cost means of operation to solve the loss of ejector motive pumping potential (i.e., performance) when low or very low potential of work recovery operation is experienced (e.g., heating at ambient temperatures >30° F. (>−1.1° C.)). Under these cases and in prior art a parallel expansion device (e.g., orifice, TXV, EXV) usually is utilized to bypass the ejector. This may eliminate the need for a ejector bypass with an expansion device.

As an alternative, a temperature may be used as a proxy. For example the temperature $T_L$ may serve as a rough proxy for $P_H$. One can also control based on $T_{sat}$ which is the saturation temperature and provides a more direct proxy for $P_H$. This may be measured by a temperature sensor (not shown) at an intermediate location along the condenser 30 where there is expected to be two-phase refrigerant. In the flowchart calculations, corresponding reference temperatures may replace $P_{high}$ and $P_{low}$.

The system may be made using otherwise conventional or yet-developed materials and techniques. Exemplary temperature sensors are thermocouples, thermistor-type sensors, and resistance temperature detectors. Exemplary pressure sensors are diaphragm-type or bellows-type. This may include retrofitting existing systems or reengineering existing system configurations.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A method for operating a heat pump (20), the heat pump comprising:

a compressor (22);

an indoor heat exchanger (26);

an outdoor heat exchanger (24);

an ejector (60) having a primary flow inlet (66), a secondary flow inlet (70), and an outlet (68);

a vessel (80) having:

an inlet port (81), a first outlet port (82), and a second outlet port (83);

a first flowpath leg (530) between the second outlet port (83) and the outdoor heat exchanger and having a first segment (530-1) and a second segment (530-2) having a junction;

a second flowpath leg (536) between the junction and the indoor heat exchanger;

a first check valve (88); and a second check valve (96), the method comprising:

operating in a cooling mode wherein heat is absorbed by refrigerant in the indoor heat exchanger and rejected by refrigerant in the outdoor heat exchanger;

in the cooling mode, the first check valve blocking a reverse flow along the first segment (530-1) from the vessel second outlet port to the outdoor heat exchanger;

in the cooling mode, the second check valve passing a flow along the second flowpath leg (536) from the outdoor heat exchanger to the indoor heat exchanger, switching to operation in a heating mode wherein heat is rejected by refrigerant in the indoor heat exchanger, heat is absorbed by refrigerant in the outdoor heat exchanger, and there is an ejector motive flow and ejector secondary flow; and in the heating mode:

the first check valve passing a flow along the first segment (530-1) from the vessel second outlet port to the outdoor heat exchanger;

the second check valve blocking a reverse flow along the second flowpath leg (536) from the outdoor heat exchanger to the indoor heat exchanger;

measuring a refrigerant pressure or temperature;

responsive to the measured refrigerant pressure or temperature:

changing a fan speed of an indoor fan; and the changing the fan speed comprises increasing fan speed when the measured pressure exceeds a first threshold pressure ($P_{high}$) and decreasing fan speed when the measured pressure falls below a second threshold pressure ($P_{low}$) lower than the first threshold pressure.

2. The method of claim 1 wherein:

the ejector is a non-controllable ejector.

3. The method of claim 1 wherein:

in the cooling mode there is no motive flow to the ejector.

4. The method of claim 1 wherein:

in the heating mode, refrigerant passes from the indoor heat exchanger as the ejector motive flow.

5. The method of claim 1 wherein:

in the cooling mode, flow passes through an expansion device (98) to the indoor heat exchanger; and in the heating mode, there is no flow through the expansion device and flow passes along said first flowpath leg (530) from the vessel second outlet port (83) to the outdoor heat exchanger (24) without expansion in any expansion device device.

6. The method of claim 1 wherein:

the ejector is a controllable ejector having a control needle.

7. The method of claim 1 wherein in the heating mode:

the measuring of a refrigerant pressure is a measuring of a discharge pressure of the compressor.

8. The method of claim 1 wherein in the heating mode:

when the measured pressure falls back below the first threshold pressure ($P_{high}$) the increased fan speed is maintained while the measured pressure remains between the first threshold pressure ($P_{high}$) and the second threshold pressure ($P_{low}$).

9. The method of claim 8 wherein:

the ejector is a non-controllable ejector.

10. A heat pump (20) having a controller (200) configured to perform the method of claim 1.

11. The heat pump (20) of claim 10 wherein the controller is configured so that:

in the cooling mode, flow passes through an expansion device (98) to the indoor heat exchanger; and in the heating mode, there is no flow through the expansion device.

12. The heat pump (20) of claim 10 wherein the controller is configured so that:

in the cooling mode, flow passes through an expansion device (98) to the indoor heat exchanger; and in the heating mode, flow passes to the outdoor heat exchanger without expansion in an expansion device.

13. The heat pump (20) of claim 10 wherein:

the ejector is a controllable ejector having a needle;

the method includes responsive to the measured refrigerant pressure or temperature actuating the needle; and the controller is configured so that:

the actuating the needle of the ejector comprises retracting the needle when the measured pressure exceeds the first threshold pressure ($P_{high}$) and extending the needle when the measured pressure falls below the second threshold pressure ($P_{low}$).

14. The heat pump (20) of claim 10 wherein there is no expansion device in parallel with the ejector for bypassing the ejector.

15. A heat pump (20), the heat pump comprising:

a compressor (22);

an indoor heat exchanger (26) having a first port (56) a second port (57) and a third port (59);

a fan (38) positioned to drive an air flow (34) across the indoor heat exchanger;

an outdoor heat exchanger (24) having a first port (55) and a second port (58);

an ejector (60) having a primary flow inlet (66), a secondary flow inlet (70), and an outlet (68);

a vessel (80) having:

an inlet port (81), a first outlet port (82), and a second outlet port (83);

a controller (200), at least one of the ejector being a controllable ejector and the fan being a variable speed fan controlled by the controller; and means for switching between:

a cooling mode wherein heat is absorbed by refrigerant in the indoor heat exchanger and rejected by refrigerant in the outdoor heat exchanger; and a heating mode wherein heat is rejected by refrigerant in the indoor heat exchanger, heat is absorbed by refrigerant in the outdoor heat exchanger, and there is an ejector motive flow and ejector secondary flow, wherein the controller (200) is configured to in the heating mode:

measure a refrigerant pressure or temperature; and responsive to the measured refrigerant pressure or temperature, change the fan speed, wherein:

the means includes:

a first check valve (88) positioned to pass flow from the indoor heat exchanger first port (56) to the outdoor heat exchanger (second port (58) in the heating mode but block a reverse flow in the cooling mode; and a second check valve (96) positioned to pass a flow from the outdoor heat exchanger second port (58) to the indoor heat exchanger third port (59) in the cooling mode but block a reverse flow in the heating mode.

16. The heat pump (20) of claim 15 wherein the controller is configured so that:

in the cooling mode, flow passes through an expansion device (98) to the indoor heat exchanger third port (59); and in the heating mode, there is no flow through the expansion device.

17. The heat pump (20) of claim 15 wherein the controller is configured so that:

in the cooling mode, flow passes through an expansion device (98) to the indoor heat exchanger third port (59); and in the heating mode, flow passes to the outdoor heat exchanger second port (58) without expansion in an expansion device.

18. The heat pump (20) of claim 15 wherein the controller is configured so that:

the changing the fan speed comprises increasing fan speed when the measured pressure exceeds a first threshold pressure ($P_{high}$) and decreasing fan speed when the measured pressure falls below a second threshold pressure ($P_{low}$) lower than the first threshold pressure.

19. The heat pump (20) of claim 15 wherein:

the controller is configured to, in the heating mode:

actuate a needle of the ejector; and the controller is configured so that:

the actuating the needle of the ejector comprises retracting the needle when the measured pressure exceeds a first threshold pressure ($P_{high}$) and extending the needle when the measured pressure falls below a second threshold pressure ($P_{low}$) lower than the first threshold pressure.

20. The heat pump (20) of claim 15 wherein at least one of: there is no expansion device in parallel with the ejector; and the ejector is a non-controllable ejector.

21. A method for operating a heat pump (20), the heat pump comprising:

a compressor (22);

an indoor heat exchanger (26) having a first port (56) a second port (57) and a third port (59);

an outdoor heat exchanger (24) having a first port (55) and a second port (58);

an ejector (60) having a primary flow inlet (66), a secondary flow inlet (70), and an outlet (68);

a vessel (80) having:

an inlet port (81), a first outlet port (82), and a second outlet port (83);

a first check valve (88); and a second check valve (96), the method comprising:

operating in a cooling mode wherein heat is absorbed by refrigerant in the indoor heat exchanger and rejected by refrigerant in the outdoor heat exchanger and there is no motive flow to the ejector;

in the cooling mode, the first check valve blocking a reverse flow along a flowpath leg (530-1) from the vessel second outlet port to the outdoor heat exchanger;

in the cooling mode, the second check valve passing a flow along a flowpath leg (536) from the outdoor heat exchanger second port (58) to the indoor heat exchanger third port (59);

switching to operation in a heating mode wherein heat is rejected by refrigerant in the indoor heat exchanger, heat is absorbed by refrigerant in the outdoor heat exchanger, and there is an ejector motive flow and ejector secondary flow; and in the heating mode:

the first check valve passing a flow along the flowpath leg (530-1) from the vessel second outlet port to the outdoor heat exchanger second port (58);

the second check valve blocking a reverse flow along the flowpath leg (536) from the outdoor heat exchanger third port (59) to the indoor heat exchanger second port (58);

measuring a refrigerant pressure or temperature;

responsive to the measured refrigerant pressure or temperature, at least one of:

increasing fan speed when the measured pressure exceeds a first threshold pressure ($P_{high}$) and decreasing fan speed when the measured pressure falls below a second threshold pressure ($P_{low}$) lower than the first threshold pressure; and retracting a needle of the ejector when the measured pressure exceeds a first threshold pressure ($P_{high}$) and inserting the needle when the measured pressure falls below a second threshold pressure ($P_{low}$) lower than the first threshold pressure; and when the measured pressure falls back below the first threshold pressure ($P_{high}$) the increased fan speed or retracted needle position is maintained while the measured pressure remains between the first threshold pressure ($P_{high}$) and the second threshold pressure ($P_{low}$).

22. The method of claim 21 wherein:

the ejector is a non-controllable ejector.

23. A method for operating a heat pump (20), the heat pump comprising:

a compressor (22);

an indoor heat exchanger (26) having a first port (56) a second port (57) and a third port (59);

an outdoor heat exchanger (24) having a first port (55) and a second port (58);

an ejector (60) having a primary flow inlet (66), a secondary flow inlet (70), and an outlet (68);

a vessel (80) having:

an inlet port (81), a first outlet port (82), and a second outlet port (83);

a first check valve (88); and a second check valve (96), the method comprising:

operating in a cooling mode wherein heat is absorbed by refrigerant in the indoor heat exchanger and rejected by refrigerant in the outdoor heat exchanger and flow passes through an expansion device (98) to the indoor heat exchanger third port (59);

in the cooling mode, the first check valve blocking a reverse flow along a flowpath leg (530-1) from the vessel second outlet port to the outdoor heat exchanger second port (58);

in the cooling mode, the second check valve passing a flow along a flowpath leg (536) from the outdoor heat exchanger second port (58) to the indoor heat exchanger third port (59);

switching to operation in a heating mode wherein heat is rejected by refrigerant in the indoor heat exchanger, heat is absorbed by refrigerant in the outdoor heat exchanger, and there is an ejector motive flow and ejector secondary flow and there is no flow through the expansion device; and in the heating mode:

the first check valve passing a flow along the flowpath leg (530-1) from the vessel second outlet port to the outdoor heat exchanger second port (58);

the second check valve blocking a reverse flow along the flowpath leg (536) from the outdoor heat exchanger second port (58) to the indoor heat exchanger;

measuring a refrigerant pressure or temperature;

responsive to the measured refrigerant pressure or temperature, at least one of:

increasing fan speed when the measured pressure exceeds a first threshold pressure ($P_{high}$) and decreasing fan speed when the measured pressure falls below a second threshold pressure ($P_{low}$) lower than the first threshold pressure; and retracting a needle of the ejector when the measured pressure exceeds a first threshold pressure ($P_{high}$) and inserting the needle when the measured pressure falls below a second threshold pressure ($P_{low}$) lower than the first threshold pressure; and when the measured pressure falls back below the first threshold pressure ($P_{high}$) the increased fan speed or retracted needle position is maintained while the measured pressure remains between the first threshold pressure ($P_{high}$) and the second threshold pressure ($P_{low}$).

24. The method of claim 23 wherein:

in the heating mode, the ejector motive flow passes from the indoor heat exchanger second port (57);

in the cooling mode, refrigerant flows from the indoor heat exchanger first port (56) to the outdoor heat exchanger first port (55) via the compressor; and the fan is an indoor fan.

25. The method of claim 23 wherein:

the ejector is a controllable ejector having a control needle.

26. The method of claim 25 wherein:

the method includes said responsive to the measured refrigerant pressure or temperature:

retracting the needle of the ejector when the measured pressure exceeds the first threshold pressure ($P_{high}$) and inserting the needle when the measured pressure falls below the second threshold pressure ($P_{low}$).

* * * * *